US007074164B2

(12) United States Patent
Moring, Jr. et al.

(10) Patent No.: US 7,074,164 B2
(45) Date of Patent: Jul. 11, 2006

(54) POSITIVE RESISTANCE TRAINING DEVICE

(76) Inventors: Tommy Moring, Jr., 1662 Highbluff, San Marcos, CA (US) 92078; Christiaan Hamilton, 2033 San Elijo Ave., #323, Cardiff, CA (US) 92007

( * ) Notice: Subject to any disclaimer, the term of this patent is extended or adjusted under 35 U.S.C. 154(b) by 280 days.

(21) Appl. No.: 10/850,263

(22) Filed: May 21, 2004

(65) Prior Publication Data

US 2005/0272571 A1 Dec. 8, 2005

(51) Int. Cl.
*A63B 21/00* (2006.01)

(52) U.S. Cl. ..... 482/112; 482/142; 482/104

(58) Field of Classification Search ..... 482/112, 482/108, 97, 104–107, 130, 72, 95, 96, 54

See application file for complete search history.

(56) References Cited

U.S. PATENT DOCUMENTS

| | | | | |
|---|---|---|---|---|
| 3,970,302 | A * | 7/1976 | McFee | 482/53 |
| 4,786,051 | A * | 11/1988 | Mullican | 482/138 |
| 5,346,444 | A * | 9/1994 | Hsieh | 482/53 |
| 5,626,543 | A * | 5/1997 | Chen | 482/112 |
| 5,653,666 | A * | 8/1997 | Pantoleon | 482/112 |
| 5,658,225 | A * | 8/1997 | Huang | 482/72 |
| 5,924,965 | A * | 7/1999 | Vardy | 482/112 |
| 5,951,448 | A * | 9/1999 | Bolland | 482/112 |

* cited by examiner

*Primary Examiner*—Jerome Donnelly
(74) *Attorney, Agent, or Firm*—Steven W. Webb

(57) ABSTRACT

An improved exercise machine is revealed, consisting of an air spring added to standard weight training incline benches. The air spring provides positive resistance to the muscles used to push the weight up the incline. The positive resistance to movement supplied by this device has been shown to increase the strength of fast-twitch muscles when exercising.

2 Claims, 5 Drawing Sheets

POSITIVE RESISTANCE TRAINING DEVICE

FIELD OF THE INVENTION

This invention relates to exercise equipment involved in weight and agility training. This invention particularly relates to devices for fast and slow-twitch muscle training, using air springs.

BACKGROUND OF THE INVENTION

It is necessary to use the proper training techniques to achieve optimum muscle strengthening and toning. In particular, athletes with special performance requirements, for example agility or endurance, require specific training techniques and regimens. Athletes with rehabilitation requirements require a separate set of techniques To support these regimens, special equipment has been developed over the past few years targeting individual muscle groups. The equipment isolates the stress exercise on certain muscles and muscle groups while minimizing stress on the remainder of the body.

SUMMARY OF THE INVENTION

The present invention is a modification to existing athletic training devices. By adding a simple air spring, in one of several possible shapes and configurations, it is possible to isolate training stress on individual leg, back, or other muscle groups. The first embodiment of this invention is targeted for leg muscles, but the concept is applicable to other training targets.

In particular, this improvement to the standard leg press helps to stress both fast- and slow-twitch muscles. Usual training regimens for the legs tend to increase muscle mass for only the slow-twitch muscles. Fast-twitch muscles are key to athletic agility and need to be strengthened with a training regimen, but ordinary exercise machines fail to address them.

Fast-twitch muscle training is accomplished by adding a positive-stress-inducing element, an air spring, to the ordinary negative stress inducing weights, The usual regimen is that an athlete sits in a special chair and places his legs against pressure pedals, usually at an upward slant. By pushing a weight upwards against the force of gravity, the slow-twitch muscles are exercised.

The inventors have discovered that by adding positive resistance, an air spring, to the upward travel of the weights, the fast-twitch muscles can be exercised at the same time. This advance is responsible for measurable increases in leg strength not obtained with ordinary weight training systems. The concept can be applied to training muscle groups other than the legs.

This invention provides an exact reaction to the action of pushing against the apparatus. Pushing with 120 lbs of force produces a 120 lb counter force. This principle can also be applied to apparatuses that are pulled on, such as pull-down equipment.

The force is designed to be applied to the muscle at the full-extension of the muscle being exercised. State-of-the-art exercise machines provide the highest resistance at the beginning of the muscle extension, such as with the leg press machine. Adding the additional resistance force at the end of the muscle extension exercises the fast-twitch muscles not reached by state-of-the-art machines.

In particular, during rehabilitation training, use of the positive resistance at the end of muscle extension accelerates recovery of both muscle strength and flexibility.

BRIEF DESCRIPTION OF THE DRAWINGS

The features of this invention will be best understood from the accompanying drawings, taken in conjunction with the accompanying description.

DESCRIPTION OF THE PREFERRED EMBODIMENT

Figure 1:
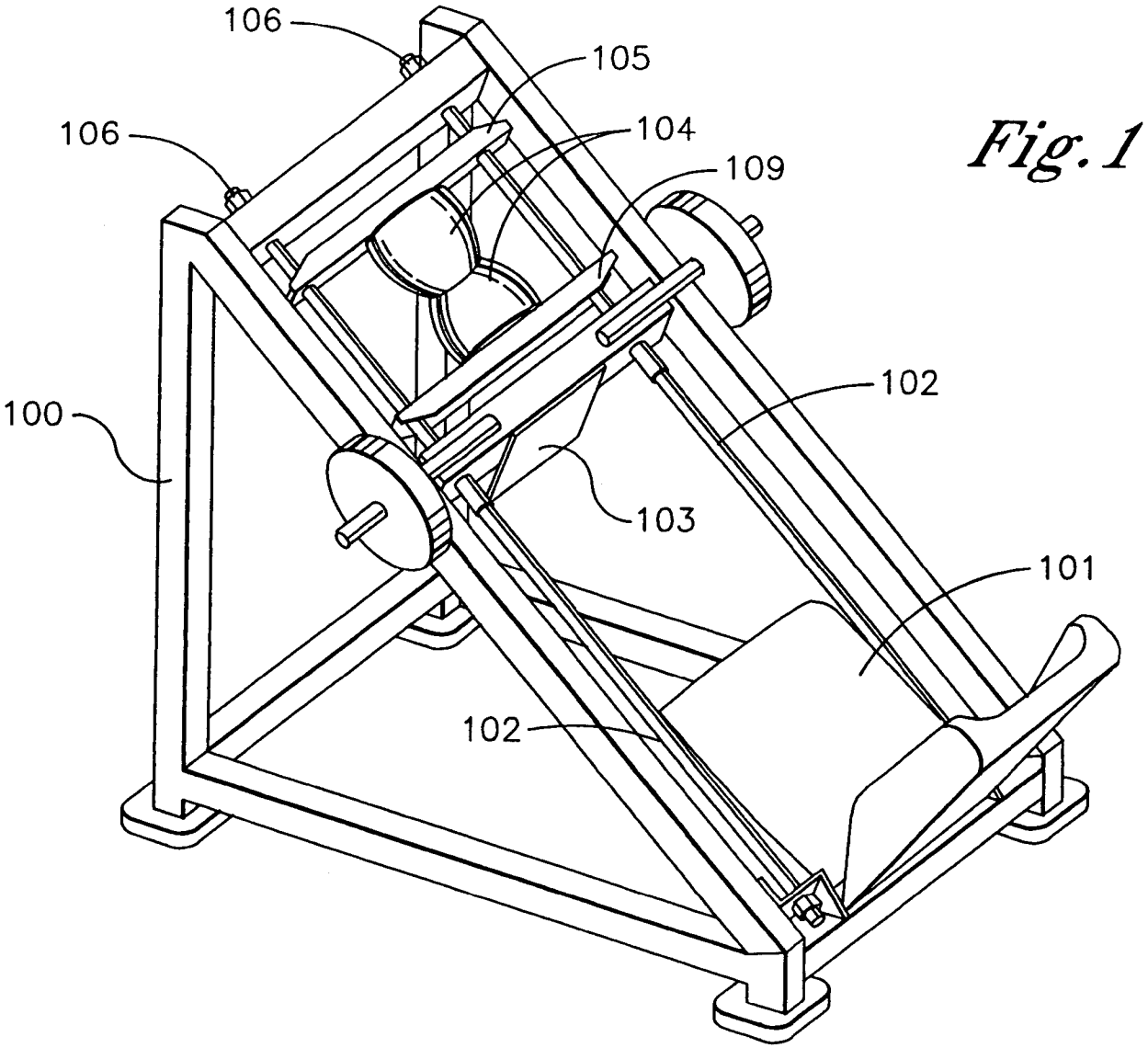
FIG. 1 is a perspective view of the invention on a weight bench
Figure 2:
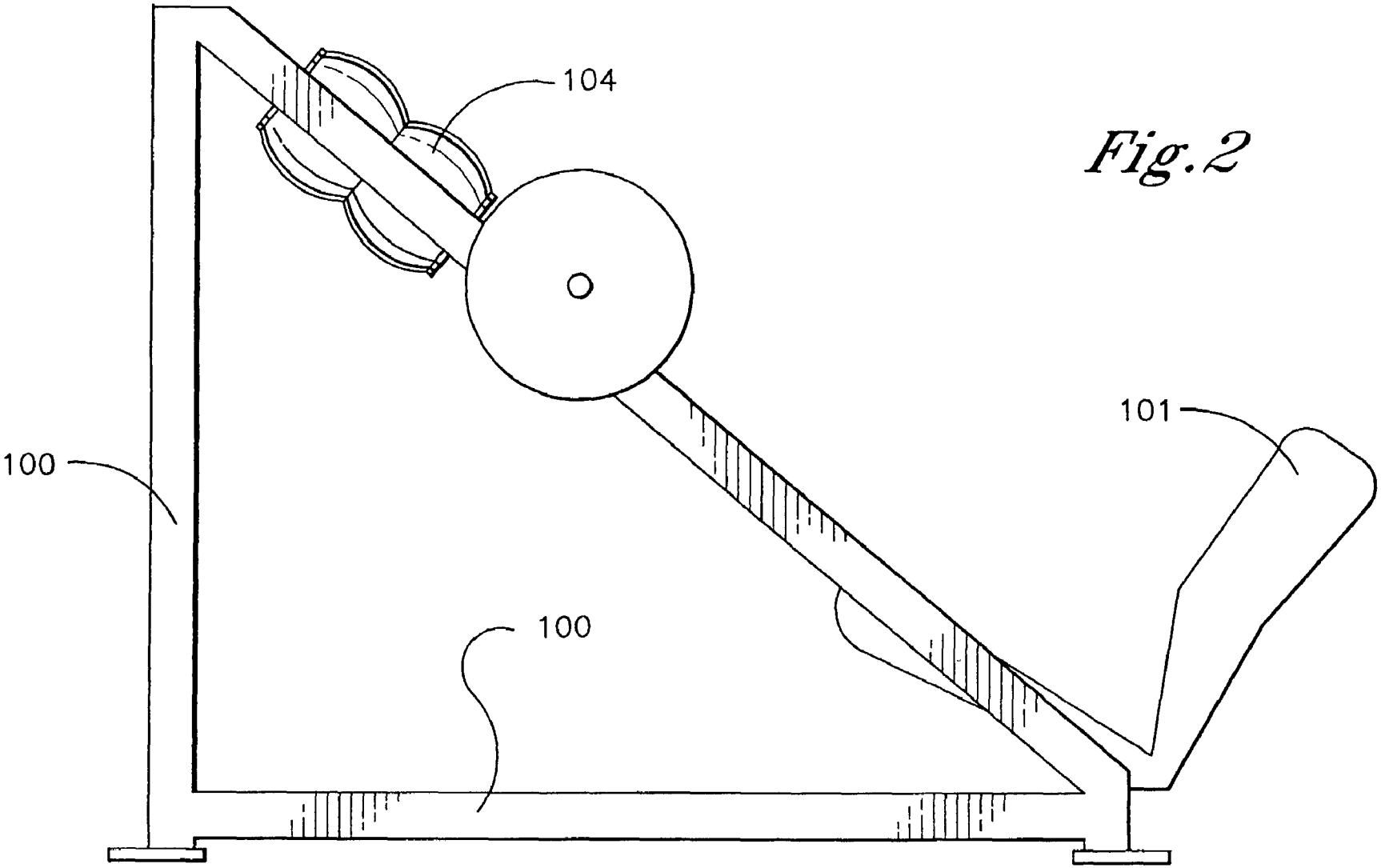
FIG. 2 is side view of the invention/weight bench
Figure 3:
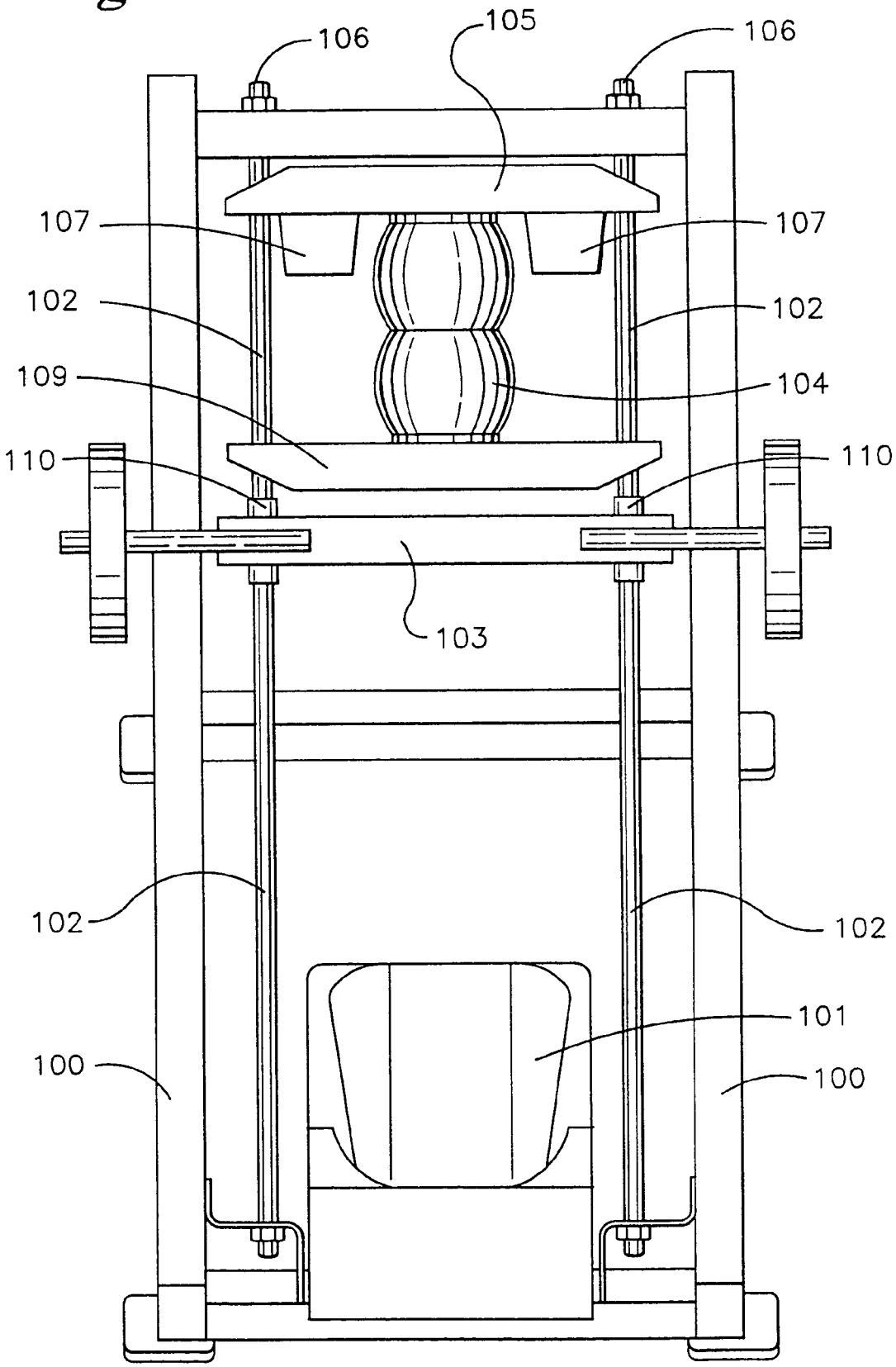
FIG. 3 is a top view of the invention/weight bench
Figure 4:
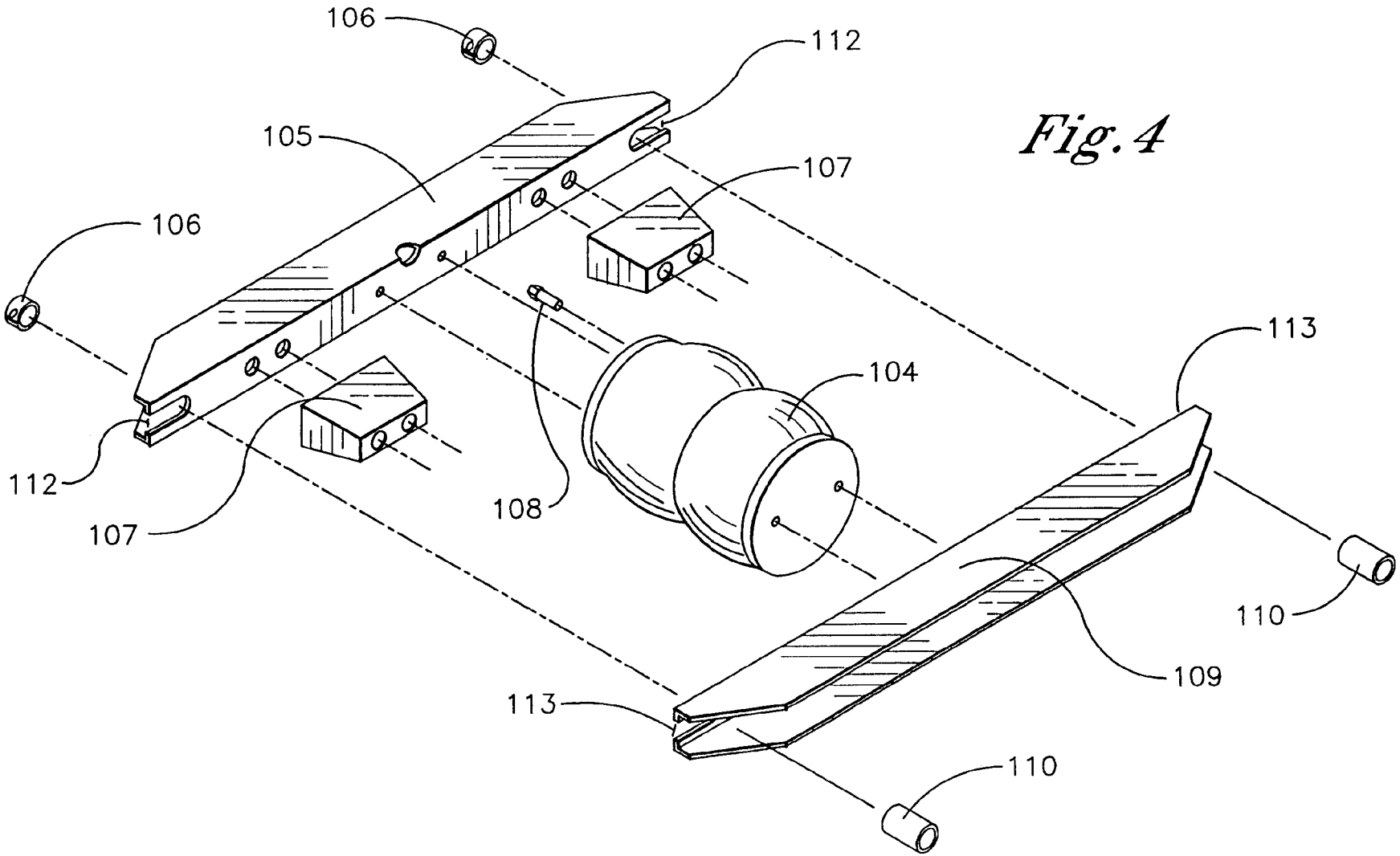
FIG. 4 is an exploded view of the invention itself

The invention can be seen best in FIG. 4, and it consists of an air spring assembly[104], a fixed crossbar[105], two shaft clamps[106], two limit stops[107], an air fitting[108], a sliding crossbar[109], and two sliding bearings[110], two fixed crossbar retainers[112], and two sliding crossbar retainers[113]. The exploded view reveals how the invention is assembled. Note that the air fitting[108] is "above" the fixed crossbar[105] when the air spring assembly[104] is attached to the fixed crossbar[105]. This permits the air spring assembly[104] air pressure to be adjusted.

The invention is attached to a weight bench[100] by sliding the fixed crossbar retainers[112] over the weight bench sliding shafts[102] and attaching the shaft clamps[106] to secure the fixed crossbar[105] to the bench. The air spring assembly[104] is then attached fixedly to the fixed crossbar[105]. The sliding crossbar[109] is then placed over the weight bench sliding shafts[102] and secured in movable manner to the weight bench sliding shafts[102] by means of the sliding bearings[110]. The other end of the air spring assembly[104] is secured fixedly to the sliding crossbar[109].

The device is operated by the user sitting in the weight bench chair[101] and placing his feet against the foot pad[103]. The user then pushes with his legs against the foot pad[103] until the foot pad[103] encounters the sliding crossbar[109].

At that point, the user is experiencing negative resistance from the weight under the influence of gravity, plus positive resistance from the compression of the air spring assembly[104]. This combination of stresses is not available from any existing exercise equipment and is a unique feature of this invention.

From this point, the exercise motion attacks both slow-twitch and fast-twitch muscles, exercising them both simultaneously.

Air spring assembly[104] resistance can be adjusted by means of inflating/deflating the assembly[104] by means of the air fitting[108].

Figure 5:
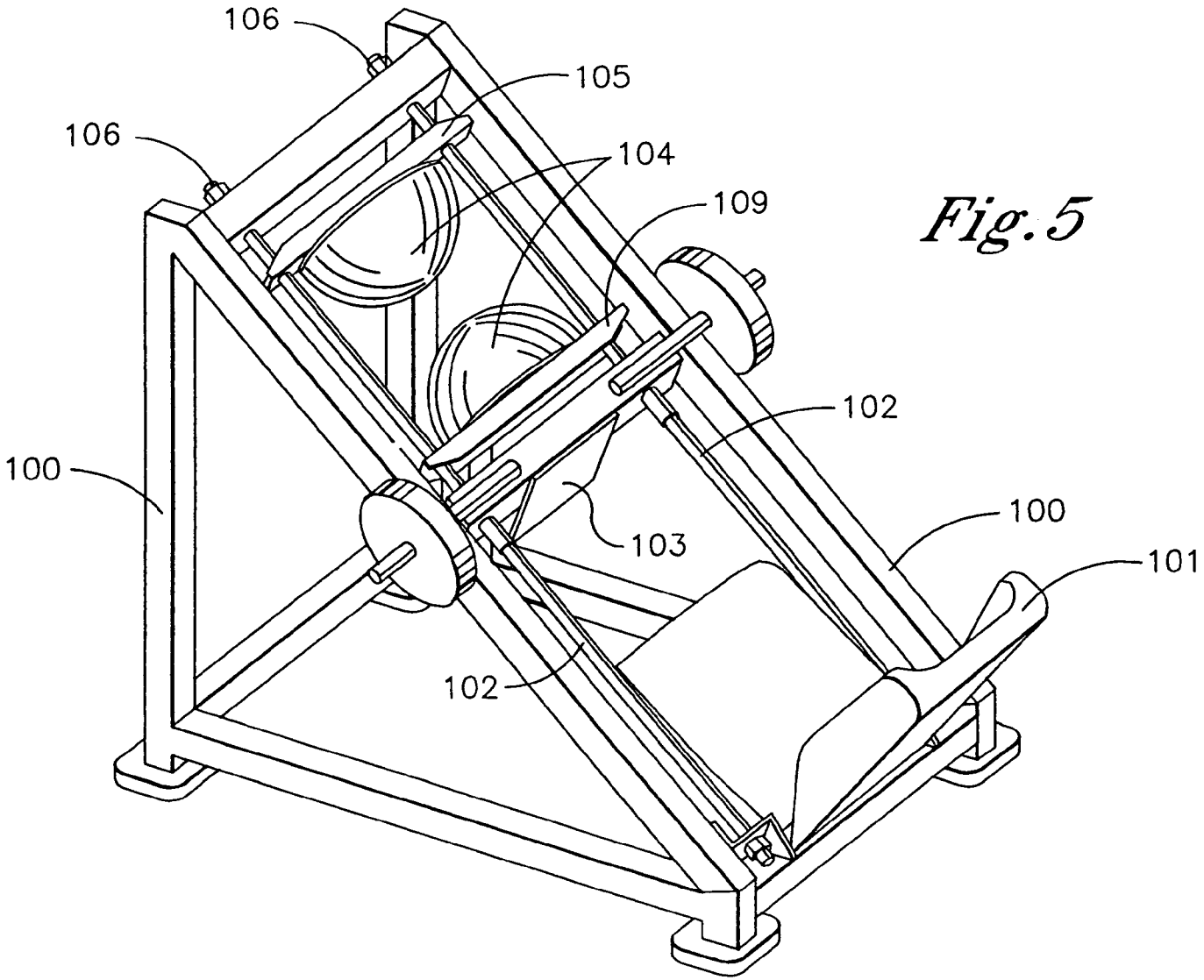
FIG. 5 is a perspective view of an alternate embodiment

In an alternate embodiment, as in FIG. 5, the air spring assembly[104] is comprised of two inflatable hemispheres[120], one attached fixedly to the fixed cross bar[105] and one attached fixedly to the sliding cross bar[109]. As is evident from the figure, the motion of pushing the weight up by means of pressing on the foot pad[103] will eventually cause the two hemispheres[120] to meet and compress each other. The hemispheres[120] can be inflated/deflated to adjust the positive resistance experienced by the user, similarly to the unitary air spring assembly[104].

Several alternate air spring assemblies[104] are possible, including pistons and balls and the like. While the foregoing describes a preferred embodiment, variation on this design and equivalent designs may be resorted to in the scope and spirit of the claimed invention.

The invention claimed is:

1. What is claimed in an improved positive resistance training device to be used with a weight training bench having an inclined track and a weight element slidably attached to the inclined track, the improvement comprising:

a fixed cross bar, an air spring assembly in the form of a bladder in the shape of an hourglass having ends, a sliding cross bar having a sliding bearing member attached thereto, The fixed cross bar being removably attached to said bench at a limit of the upward travel of the weight on the inclined track, one end of the air spring assembly removably attached to the fixed cross bar, the other end of the air spring assembly removably attached to the sliding cross bar, the sliding cross bar attached in a sliding fashion to said inclined track by a sliding bearing, the weight positioned below the sliding cross bar and the weight being attached in a sliding fashion to the inclined track, and;

wherein when the weight is pushed up the incline by the user, the weight encounters the sliding cross beam to compress the air spring assembly to create a positive resistance force on a users muscles when pushing the weight up the incline in addition to the negative force applied by pushing the weight up the incline, and further including an adjustment means of inflating and deflating the air spring assembly and a means of adjustably positioning the device on the inclined track so that short or long motions of the weight up the incline can be accommodated, the application of positive resistance force intended to exercise fast-twitch muscles in the user's body.

2. What is claimed in an improved positive resistance training kit to be used with an a weight training bench, having an inclined track and a weight element slidably attached to the inclined track, the improvement comprising:

an air spring assembly a fixed cross bar, a sliding cross bar having a sliding bearing member attached thereto, The fixed cross bar being removably attached to said bench at a limit of the upward travel of the weight on the inclined track, the sliding cross bar attached in a sliding fashion to said inclined track by a sliding bearing the weight positioned below the sliding cross bar and the weight being attached in a sliding fashion to the inclined track, and:

wherein when the weight is pushed up the incline by the user the weight encounters the sliding cross beam to compress the air spring assembly, said air spring assembly being comprised of two hemispherical bladders, their flat sides attached to respective cross bars, their curved sides positioned to encounter each other when the weight is pushed up the incline to create a positive resistance force on a users muscles when pushing the weight up the incline in addition to the negative force applied by pushing the weight up the incline, and further including an adjustment means of inflating and deflating the air spring assembly and a means of adjustably positioning the kit on the inclined track so that short or long motions of the weight up the incline can be accommodated, the application of positive resistance force intended to exercise fast-twitch muscles in the user's body.

* * * * *